US008657283B2

(12) United States Patent
Iwata et al.

(10) Patent No.: US 8,657,283 B2
(45) Date of Patent: Feb. 25, 2014

(54) SHEET STACKING APPARATUS AND IMAGE FORMING APPARATUS

(75) Inventors: Toshiyuki Iwata, Abiko (JP); Hideki Kushida, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/558,262

(22) Filed: Jul. 25, 2012

(65) Prior Publication Data

US 2013/0026707 A1 Jan. 31, 2013

(30) Foreign Application Priority Data

Jul. 29, 2011 (JP) ..... 2011-167588

(51) Int. Cl.
*B65H 31/36* (2006.01)

(52) U.S. Cl.
USPC ..... 271/221; 271/223; 271/222; 271/220; 271/217; 271/214

(58) Field of Classification Search
USPC ..... 271/221, 217, 214, 220, 222, 223; 414/791.2
See application file for complete search history.

(56) References Cited

U.S. PATENT DOCUMENTS

| | | | | |
|---|---|---|---|---|
| 6,832,759 | B2 * | 12/2004 | Nagasako et al. | 271/222 |
| 8,136,807 | B2 * | 3/2012 | Uchiyama et al. | 270/58.27 |
| 2002/0158405 | A1 | 10/2002 | Nagasako | |
| 2009/0243198 | A1 * | 10/2009 | Konishi | 271/221 |
| 2010/0117292 | A1 * | 5/2010 | Iwata | 271/234 |

FOREIGN PATENT DOCUMENTS

| | | | |
|---|---|---|---|
| JP | 2005-219909 | A | 8/2005 |
| JP | 2007-062907 | A | 3/2007 |

* cited by examiner

*Primary Examiner* — Luis A Gonzalez
(74) *Attorney, Agent, or Firm* — Canon USA Inc IP Division

(57) ABSTRACT

There are provided a sheet stacking apparatus capable of stably stacking a large number of sheets and an image forming apparatus. The sheet stacking apparatus configured to stack sheets includes a plurality of discharge units disposed to an apparatus main body in a vertical direction and configured to discharge sheets, a plurality of sheet stacking units disposed to be independently elevatable on a side surface of the apparatus main body corresponding respectively to the plurality of discharge units and configured to stack thereon the sheets discharged from the discharge units, and an alignment unit disposed between the plurality of sheet stacking units and configured to sequentially align a position in a width direction perpendicular to a discharging direction of the sheets stacked on a lower sheet stacking unit among the plurality of sheet stacking units.

20 Claims, 18 Drawing Sheets

SHEET STACKING APPARATUS AND IMAGE FORMING APPARATUS

BACKGROUND OF THE INVENTION

1. Field of the Invention

The present disclosure relates to a sheet stacking apparatus capable of stacking a large number of sheets to be discharged thereon, and to an image forming apparatus.

2. Description of the Related Art

The image formation speed of an image forming apparatus for forming an image on a sheet has recently been increased with technical advancements. Such an increase of the image formation speed has increased discharge speed of sheets to be discharged from an image forming apparatus body. Japanese Patent Application Laid-Open No. 2007-062907 discusses an image forming apparatus including a sheet stacking apparatus for aligning and stacking a large number of sheets discharged at high speed.

According to Japanese Patent Application Laid-Open No. 2007-062907, the sheet stacking apparatus has a plurality of discharge ports and independently elevatable stacking trays corresponding thereto. When sheets are stacked on the stacking tray, the stacking tray is moved down as the number of stacked sheets increases, so that the number of sheets stacked on the tray can be increased.

In such a related-art sheet stacking apparatus having the plurality stacking trays to increase the number of sheets to be stacked thereon, more sheets are arranged to be stacked on a lower stacking tray so that the stability of the sheet stacking apparatus is enhanced. Since the lower stacking tray stacks thereon more sheets than an upper stacking tray, the center of gravity of the entire sheet stacking apparatus can be positioned lower when a maximum number of sheets are stacked. Accordingly, the sheet stacking apparatus can be improved in the stability thereof.

When a large number of sheets are stacked on a lower stacking tray, however, there are cases where stackability of the stacking tray is deteriorated, therefore, a stable stack of the sheets becomes difficult.

SUMMARY OF THE INVENTION

The present disclosure is directed to a sheet stacking apparatus capable of stably stacking a large number of sheets thereon, and an image forming apparatus.

According to an aspect of the present embodiments disclosed herein, a sheet stacking apparatus including a plurality of discharge units in a vertical direction and configured to discharge a sheet, a plurality of mutually independent sheet stacking units elevatable manner with respect to the respective plural discharge units and configured to stack thereon the sheet discharged from the discharge units, and an alignment unit disposed between the plurality of sheet stacking units and configured to align a position in a width direction perpendicular to a discharging direction of the sheet discharged on a lower sheet stacking unit among the plurality of sheet stacking units.

According to the present disclosure, an alignment unit is disposed between a plurality of elevatable sheet stacking units, the alignment unit sequentially aligning a position in a width direction of sheets stacked on a lower sheet stacking unit among the plurality sheet stacking units. Accordingly, a large number of sheets can be stably stacked.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles disclosed herein.

DESCRIPTION OF THE EMBODIMENTS

The accompanying drawings, which are incorporated in and constitute a part of the specification, illustrate exemplary embodiments, features, and aspects of the invention and, together with the description, serve to explain the principles disclosed herein.

Figure 1:
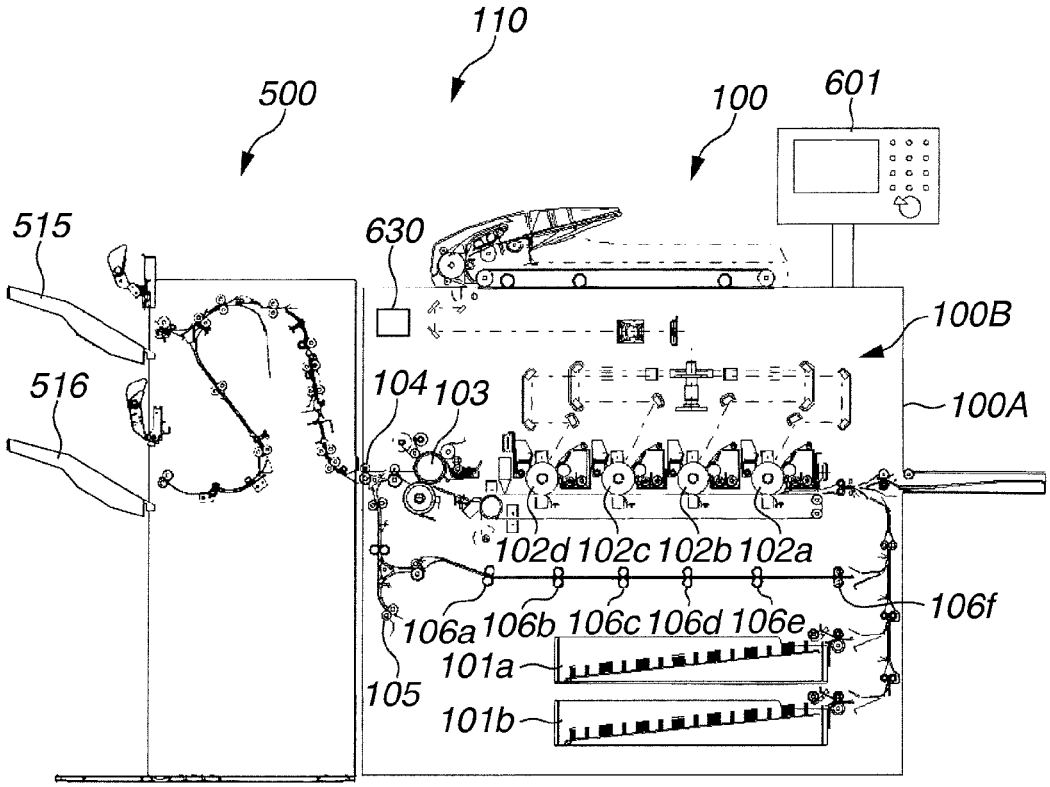
FIG. 1 is a diagram illustrating a configuration of a monochrome/color copying machine as an example of an image forming apparatus including a sheet stacking apparatus according to a first exemplary embodiment.

FIG. 1 is a diagram illustrating a configuration of a monochrome/color copying machine as an example of an image forming apparatus including a sheet stacking apparatus according to a first exemplary embodiment. As illustrated in FIG. 1, a monochrome/color copying machine 100 includes a monochrome/color copying machine body (hereinafter referred to as a copying machine body) 100A.

The copying machine body 100A includes sheet feeding cassettes 101*a* and 101*b*, an image forming unit 100B, and a fixing unit 103. Each of the sheet feeding cassettes 101*a* and 101*b* stacks thereon sheets P for image formation. The image forming unit 100B forms a toner image on a sheet using an electrophotographic process. The fixing unit 103 fixes the toner image formed on the sheet.

An operation unit 601 is connected to an upper surface of the copying machine body 100A, and a sheet stacking apparatus 500 is connected to a side of the copying machine body 100A. The operation unit 601 is used by a user to make various inputs or settings with respect to the copying machine body 100A. The sheet stacking apparatus 500 can be used as an option, and thus the copying machine body 100A can be used alone.

The sheet stacking apparatus 500 and the copying machine body 100A may be integrated. A central processing unit (CPU) circuit unit 630 is a control unit for controlling the copying machine body 100A and the sheet stacking apparatus 500.

When an image is formed by such an monochrome/color copying machine 100, toner images of four colors of yellow, magenta, cyan, and black are first formed on respective photosensitive drums 102*a* through 102*d* provided in the image forming unit 100B.

The toner images are then transferred to a sheet supplied from the sheet feeding cassette 101*a* or 101*b*. Subsequently, the toner images transferred to the sheet are fixed by the fixing unit 103. After the toner images are fixed, the sheet is discharged to the sheet stacking apparatus 500 connected to the side of the copying machine body 100A from a discharge roller pair 104 if image formation is performed in a mode in which an image is formed on one side of a sheet.

If image formation is performed in a mode in which images are formed on two sides of a sheet, the sheet is provided from the fixing unit 103 to a reversing roller 105. Then, the reversing roller 105 is reversed at a predetermined timing, so that the sheet is conveyed to a direction of two-sided conveying rollers 106*a* through 106*f*.

Subsequently, the sheet is conveyed to the image forming unit 100B again, and toner images of four colors of yellow, magenta, cyan, black are transferred to a back side of the sheet. The sheet on which the toner images of four colors are transferred is then conveyed to the fixing unit 103 again, so that the toner images on the back side are fixed. Then, the sheet is discharged from the discharge roller pair 104, and conveyed to the sheet stacking apparatus 500.

The sheet stacking apparatus 500 accepts the sheets discharged from the copying machine body 100A in sequence, and causes the sheets to be stacked on any of an upper tray 515 and a lower tray 516 serving as sheet stacking units provided on a side surface of an apparatus main body 500A.

These two trays 515 and 516 are properly used depending on situations. For example, a user can select the upper tray 515 or the lower tray 516 depending on copy output, printer output, sample output, interruption output, output in the case of overflow of stacking tray, function-sorting output, and output during a mixed job.

Figure 2:
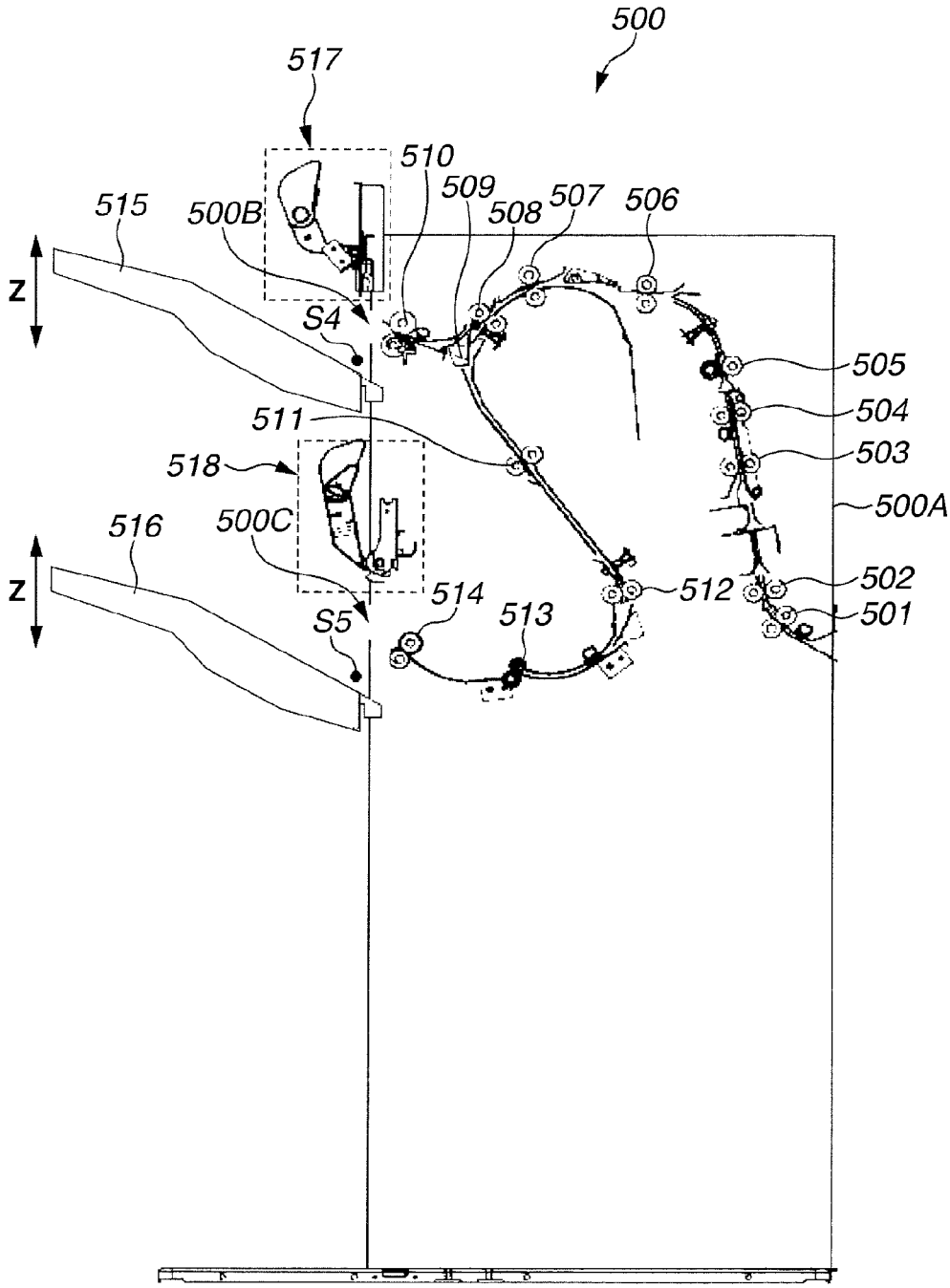
FIG. 2 is a diagram illustrating a configuration of the sheet stacking apparatus.

As illustrated in FIG. 2, the sheet stacking apparatus 500 includes an inlet roller pair 501 for receiving a sheet into the apparatus main body 500A. The sheet discharged from the copying machine body 100A is provided to the inlet roller pair 501. Then, the sheet conveyed by the inlet roller pair 501 is sequentially conveyed from conveyance roller pairs 502 through 507 to a buffer roller pair 508.

When a sheet is discharged on the upper tray 515, an upper path switching member 509 is switched from an initial position of the upper path switching member 509 by a drive unit (not shown) such as a solenoid. Accordingly, the sheet is discharged to the upper tray 515 from an upper discharge port 500B by an upper discharge roller 510. The upper discharge port 500B serves as a discharge unit provided in a vertical direction in the copying machine body 100A, and the upper tray 515 corresponds the upper discharge port 500B.

When a sheet is discharged on the lower tray 516, the upper path switching member 509 returns to the initial position by stopping the drive unit. Accordingly, the sheet is conveyed to conveyance roller pairs 511 through 513 by the upper path switching member 509, and is discharged to the lower tray 516 from a lower discharge port 500C by a lower discharge roller 514. The sheet is stacked on the lower tray 516 corresponding to the lower discharge port 500C serving as a discharge unit.

Accordingly, the sheets discharged from the copying machine body 100A are received by the sheet stacking apparatus 500 in sequence, and stacked on the upper tray 515 and the lower tray 516.

An upper tray alignment unit 517 serving as an alignment unit is disposed above the upper tray 515. The upper tray alignment unit 517 aligns a position in a width direction perpendicular to a sheet discharging direction of sheets stacked on the upper tray 515.

Moreover, a lower tray alignment unit 518 serving as an alignment unit is disposed above the lower tray 516. The lower tray alignment unit 518 aligns a position in a width direction of sheets stacked on the lower tray 516.

Figure 3A:
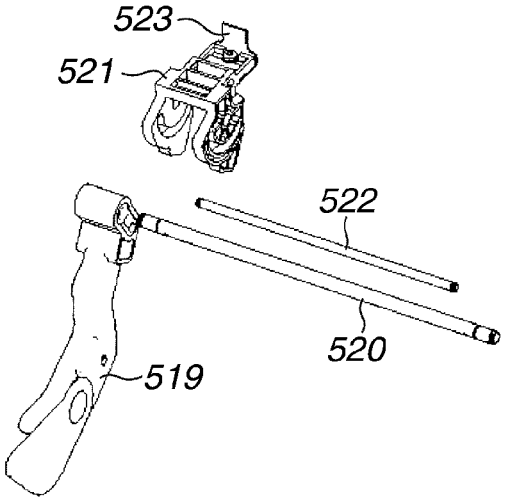
FIGS. 3A, 3B, and 3C are as a first diagram illustrating a configuration of a tray alignment unit disposed in the sheet stacking apparatus.
Figure 3B:
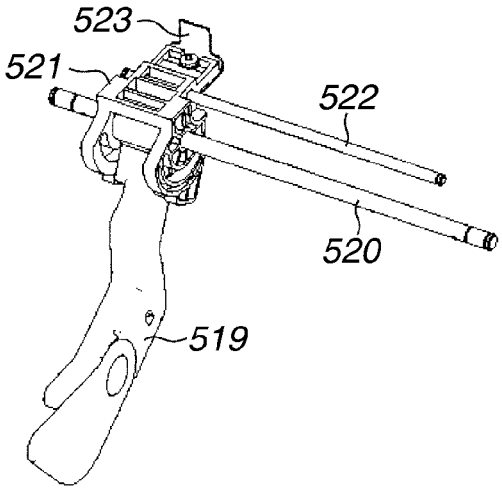
Figure 3C:
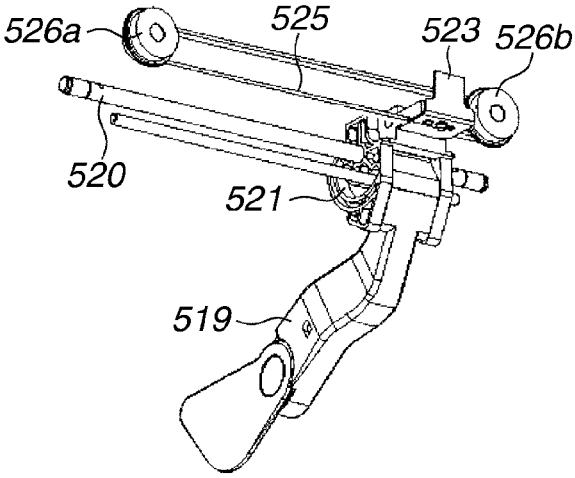

FIGS. 3A, 3B, and 3C are diagrams each illustrating a configuration of the lower tray alignment unit 518 for aligning a sheet discharged on the lower tray 516. As illustrated in FIGS. 3A and 3B, the lower tray alignment unit 518 includes an alignment member 519 for aligning a discharged sheet. The alignment member 519 is provided to each of rear and front sides, that is, the alignment members 519 are disposed to both end sides, in a width direction of the sheet stacking apparatus 500 as described with reference to FIG. 5.

The alignment member 519 is rotatably supported in a vertical direction by a first alignment spindle 520, and slides along the first alignment spindle 520 through a slide member 521 that slides along the first alignment spindle 520.

In the slide member 521, a second alignment spindle 522 serving as a rotation stopper is inserted. The second alignment spindle 522 regulates rotation of the slide member 521 when the alignment member 519 rotates in a vertical direction around the first alignment spindle 520 as described below.

As illustrated in FIG. 3C, a second slide drive transmission belt 525 is sandwiched between the slide member 521 and a slide position detection member 523.

When the second slide drive transmission belt 525 rotates, the slide position detection member 523 and the slide member 521 slide, and the alignment member 519 slides with the slide of the slide member 521.

Figure 5A:
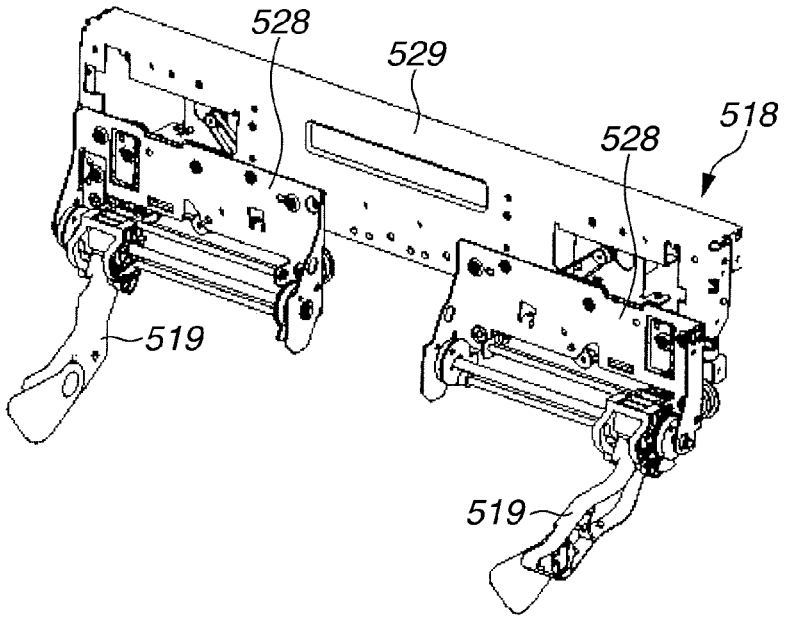
FIGS. 5A and 5B are as a third diagram illustrating a configuration of the tray alignment unit.
Figure 5B:
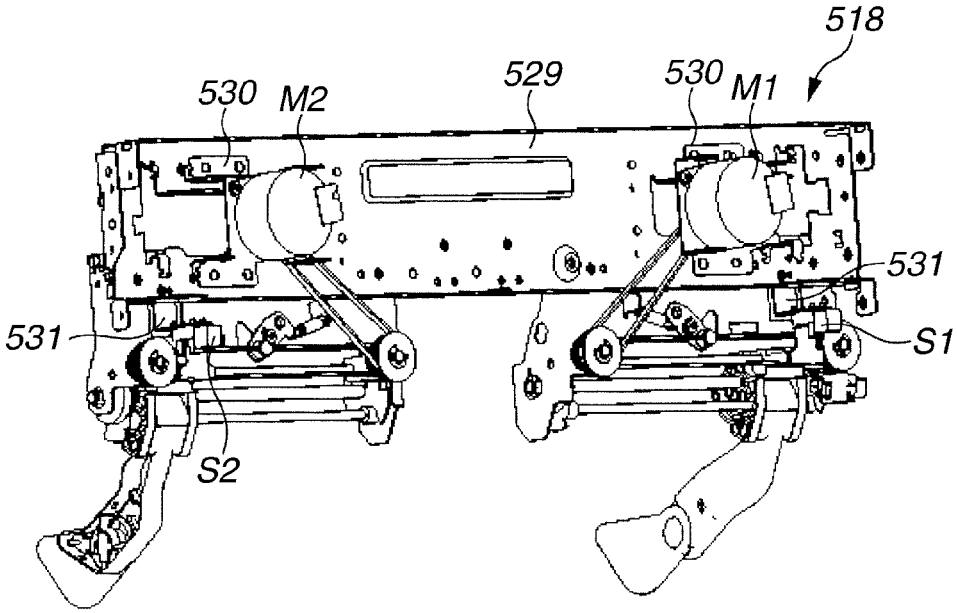

Such a slide movement of the slide position detection member 523 is detected by a rear alignment member home position (HP) sensor S1 illustrated in FIG. 5B, so that a movement of the alignment member 519 (slide member 521) to a slide HP can be detected.

Figure 4A:
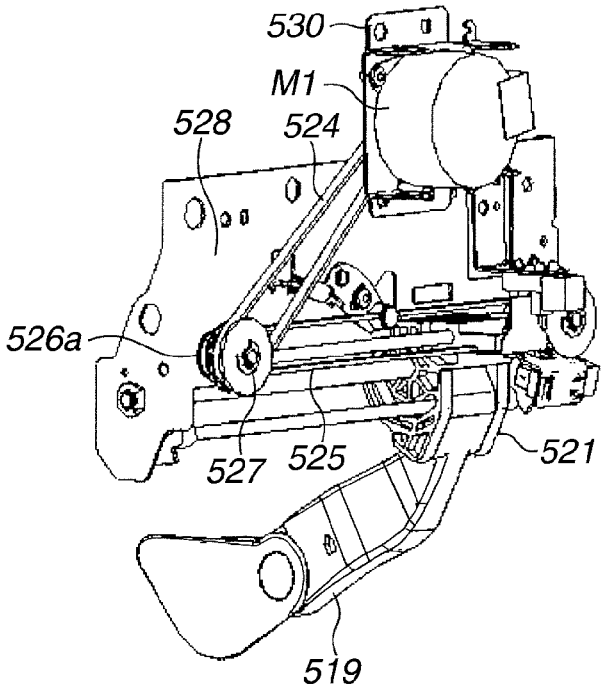
FIGS. 4A and 4B are as a second diagram illustrating a configuration of the tray alignment unit.

The second slide drive transmission belt 525 is wound across slide drive transmission pulleys 526*a* and 526*b*. The slide drive transmission pulley 526*a* is a stepped pulley as illustrated in FIG. 4A. The second slide drive transmission belt 525 and a first slide drive transmission belt 524 are wound on the slide drive transmission pulley 526*a*. The first slide drive transmission belt 524 is rotated by a rear alignment member slide motor M1.

Therefore, when the rear alignment member slide motor M1 rotates, the rotation is transmitted to the slide member 521 through the first slide drive transmission belt 524, the slide drive transmission pulley 526*a*, and the second slide drive transmission belt 525. Thus, the alignment member 519 and the slide member 521 move in a width direction (front-rear direction) while being integrally guided by the first alignment spindle 520.

As illustrated in FIG. 4A, the slide drive transmission pulley 526*a* is supported by a pulley spindle 527 swaged with a pulley support plate 528. Both ends of the first alignment spindle 520 and the second alignment spindle 522 are held on the pulley support plate 528 with E rings.

Figure 4B:
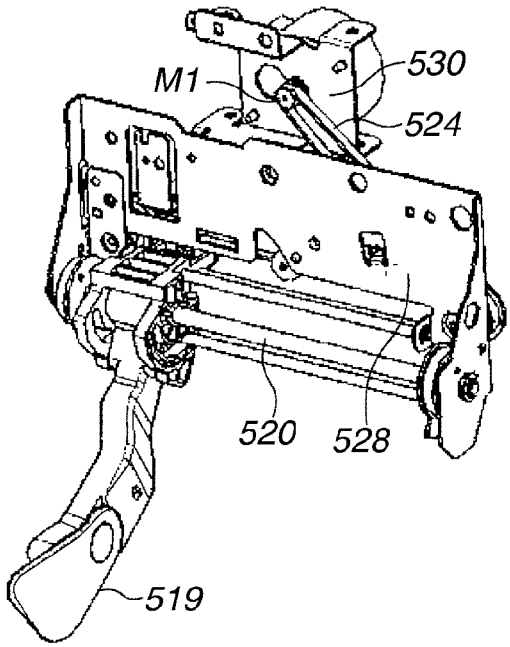

The alignment member 519, the pulley support plate 528, and other members form a unit in a state as illustrated in FIGS. 4A and 4B, and are attached to a rear side of an upper stay 529 as illustrated in FIG. 5A. In addition, the rear alignment member slide motor M1 is attached to the rear side of the upper stay 529 through a slide drive motor support plate 530 as illustrated in FIG. 5B.

A front side of the upper stay 529 of the lower tray alignment unit 518 includes a unit of the alignment member 519, the pulley support plate 528, and other members having the same configuration as that attached to the rear side of the upper stay 529, and a front alignment member slide motor M2 which are attached thereto.

As illustrated in FIG. 5B, a rear alignment member HP sensor S1 is attached to the upper stay 529 with an alignment position detection support plate 531. The rear alignment member HP sensor S1 detects a position of the rear side alignment member 519 on the rear side by detecting a position of the slide position detection member 523.

A front alignment member HP sensor S2 is attached to the upper stay 529 with the alignment position detection support plate 531. The front alignment member HP sensor S2 detects a position of the alignment member 519 on the front side.

These alignment members 519 on the rear side and the front side form a pair, and slide in a width direction, thereby aligning a sheet discharged on the lower tray 516. For example, when a sheet is discharged on the lower tray 516, the alignment members 519 on the front and rear sides are caused to slide and move from home positions thereof to respective alignment positions according to a sheet size, thereby aligning a position in a width direction of the sheet.

Figure 6A:
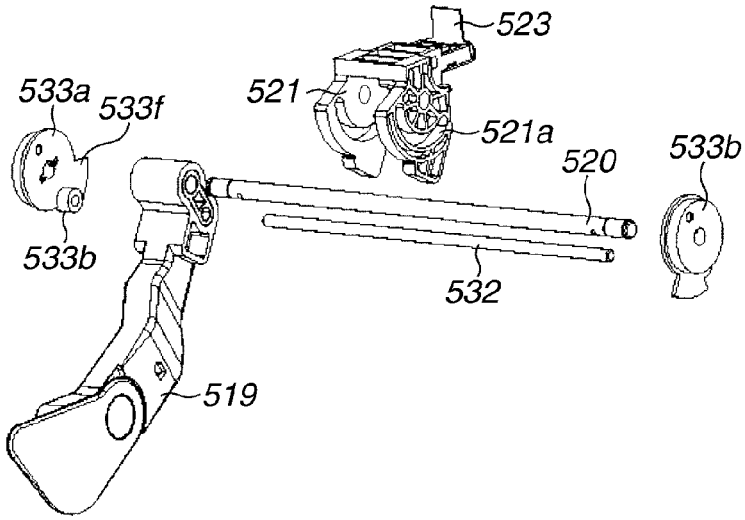
FIGS. 6A, 6B, and 6C are as a fourth diagram illustrating a configuration of the tray alignment unit.
Figure 6B:
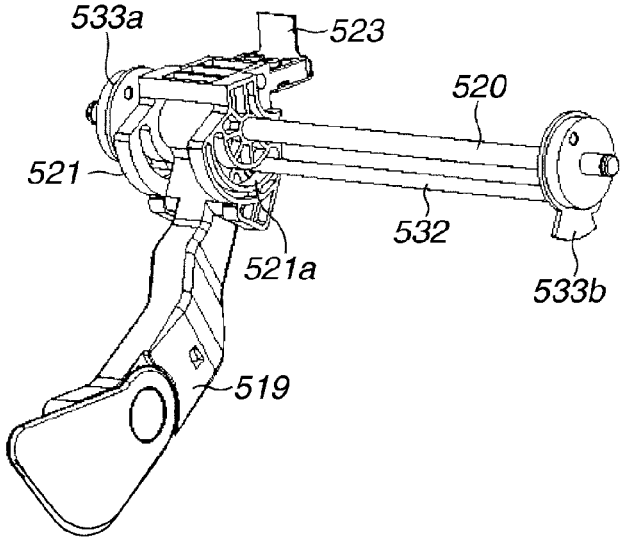
Figure 6C:
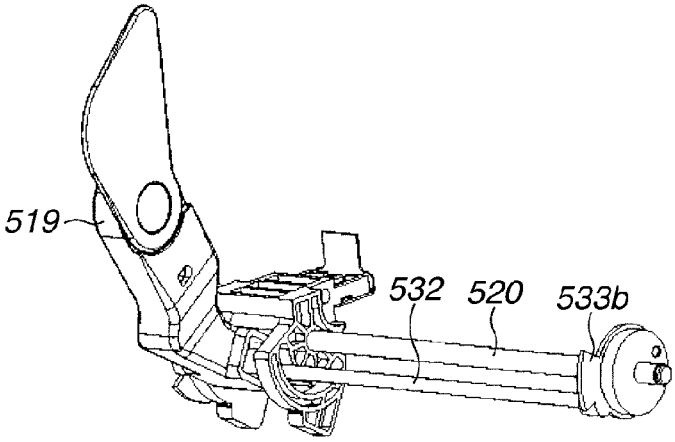

Moreover, as illustrated in FIGS. 6A, 6B, and 6C, a third spindle 532 is inserted into the alignment member 519 and a guiding groove 521*a* disposed below the slide member 521. Herein, both ends of the third spindle 532 are engaged with engagement holes 533*h* of alignment member elevating pulleys 533*a* and 533*b*, so that the third spindle 532 rotates in a vertical direction with rotation of the alignment member elevating pulleys 533*a* and 533*b*. The alignment member elevating pulleys 533*a* and 533*b* are supported by the first alignment spindle 520 as similar to the alignment member 519.

Since the first alignment spindle 520 and the alignment member elevating pulleys 533*a* and 533*b* are engaged by parallel pins (not illustrated), the alignment member elevating pulleys 533*a* and 533*b* synchronously rotate with the first alignment spindle 520.

Herein, the synchronous rotation of the alignment member elevating pulleys 533*a* and 533*b* causes the third spindle 532 to move in a vertical direction along the guiding groove 521*a* of the slide member 521, thereby elevating the alignment member 519. Herein, since the rotation of the slide member 521 is regulated by the second alignment spindle 522, only the alignment member 519 is elevated.

Figure 7:
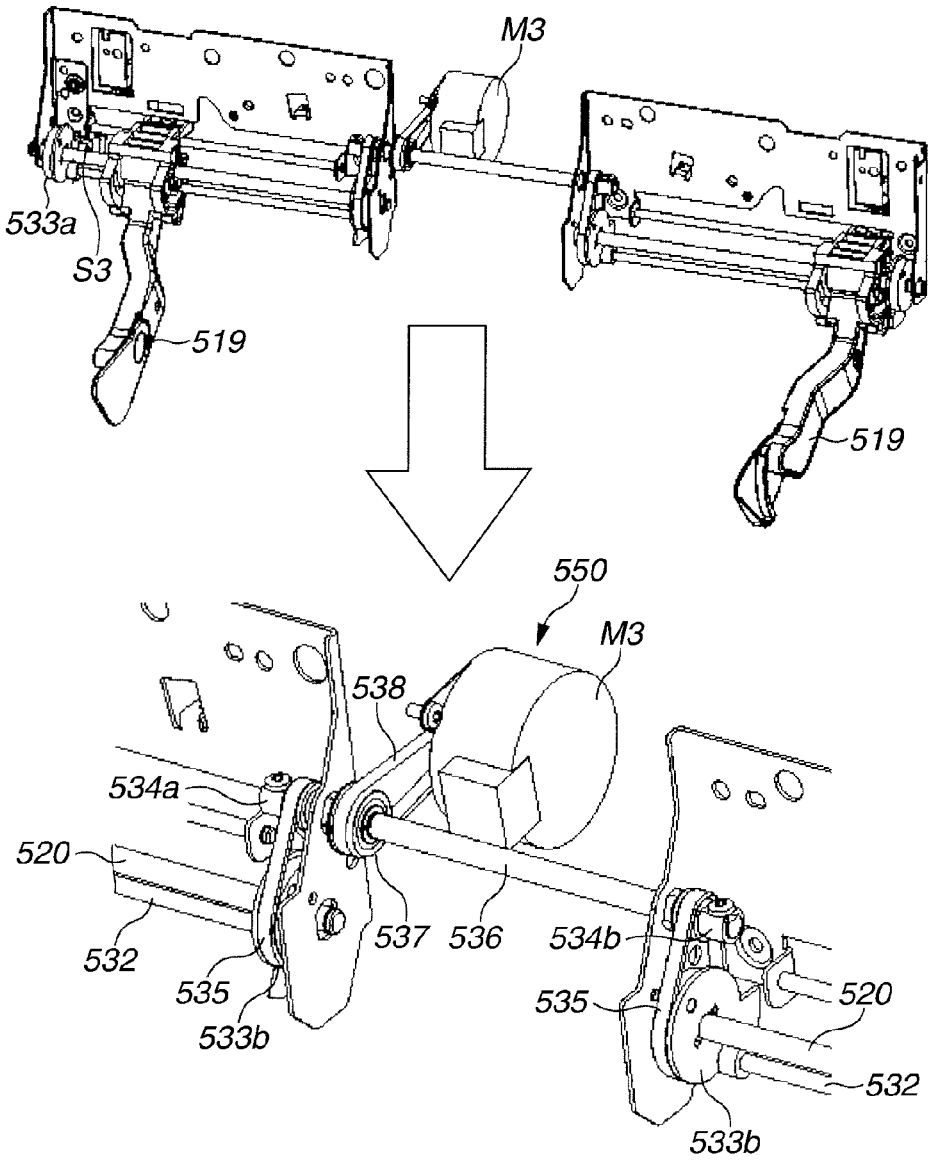
FIG. 7 is as a fifth diagram illustrating a configuration of the tray alignment unit.

As illustrated in FIG. 7, the drive transmission belts 535 are wound around the alignment member elevating pulleys 533*a* and 533*b* and second elevating pulleys 534*a* and 534*b*.

The second elevating pulleys 534*a* and 534*b* are disposed to the respective ends of an elevation transmission shaft 536, and synchronously rotate with rotation of the elevation transmission shaft 536. A third elevating pulley 537 is provided to the elevation transmission shaft 536, and a drive transmission belt 538 is wound around the third elevating pulley 537. The drive transmission belt 538 transmits drive of an alignment member elevating motor M3.

Therefore, when the alignment member elevating motor M3 rotates, the drive thereof is transmitted to the drive transmission belt 538, the third elevating pulley 537, the elevation transmission shaft 536, the second elevating pulleys 534*a* and 534*b*, and the drive transmission belt 535.

In addition, the drive of the alignment member elevating motor M3 is transmitted to the alignment member 519 through the drive transmission belt 535, the alignment member elevating pulley 533*b*, and the third spindle 532, so that the pair of the alignment members 519 is synchronized and elevated.

In the present exemplary embodiment, for example, the alignment member elevating motor M3, the drive transmission belt 538, the elevation transmission shaft 536, and the drive transmission belt 535 form a moving unit 550 for causing the alignment member 519 to move to a retracting position located above an alignable position (described below) and the lower discharge roller 514.

In the vicinity of the alignment member elevating pulley 533*a* on a rear side, an alignment member elevation HP sensor S3 is disposed. The alignment member elevation HP sensor S3 detects that the alignment member 519 reaches an elevation HP upon moving up, as described below.

As illustrated in FIG. 6A, the alignment member elevating pulley 533*a* includes a flag portion 533*f* for causing the alignment member elevation HP sensor S3 to be ON or OFF. For example, when the pair of the alignment members 519 is synchronized and elevated with rotation of the alignment member elevating pulleys 533*a* and 533*b*, the alignment member elevation HP sensor S3 is turned ON or OFF, so that an elevation position of the alignment member 519 can be detected and controlled.

According to such a configuration, for example, when sheets are stacked on the lower tray 516 by sort stacking (offset stacking) for causing the sheets to be displaced every predetermined number of sheets in a width direction and stacked, the alignment member 519 can be moved up to a retracting position. Moreover, when a user removes sheets stacked on the lower tray 516 at the end of the job, the alignment member can be moved up to the retracting position so that the sheets can be readily removed from the lower tray 516.

When sheets are stacked, each of the upper tray 515 and the lower tray 516 serving as a stacking unit is once moved up to a position in which a position of a sheet surface can be detected, and is moved down as sheets are stacked.

Figure 8A:
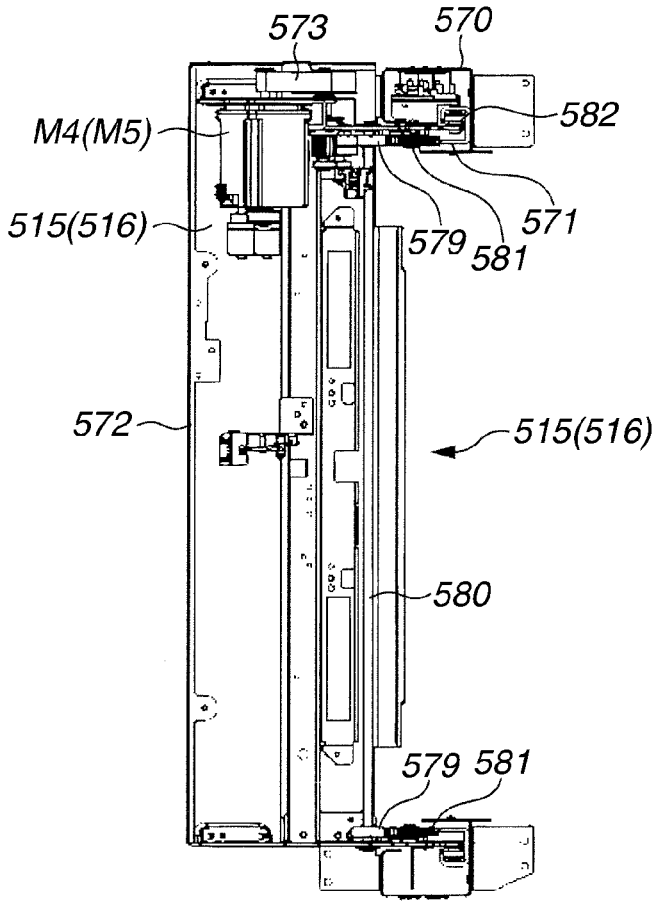
FIGS. 8A and 8B are as a first diagram illustrating an elevating mechanism for each of upper and lower trays disposed on the sheet stacking apparatus.
Figure 8B:
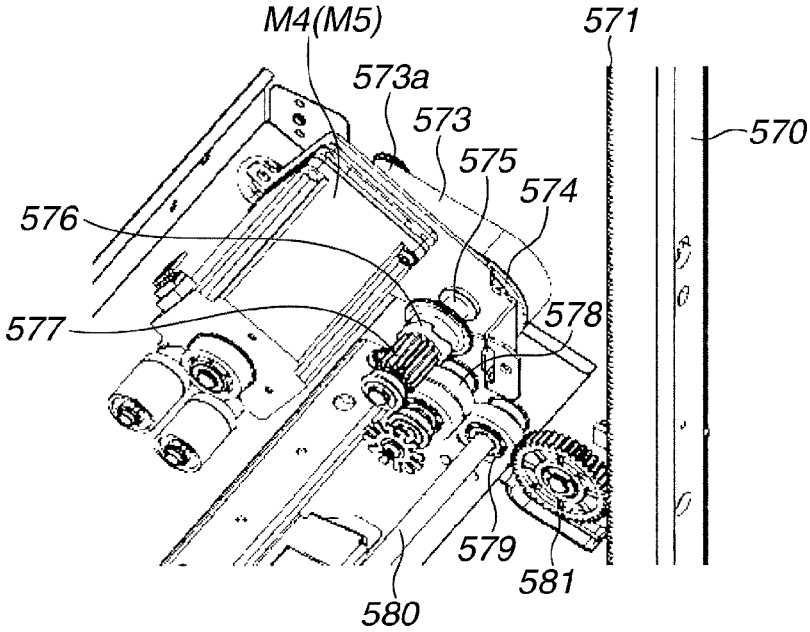

Next, a description is given of an elevation mechanism for elevating each of the upper tray 515 and the lower tray 516. As illustrated in FIGS. 8A and 8B, the upper and lower trays 515 and 516 have an upper tray drive motor M4 and a lower tray drive motor M5, respectively, so that the upper and lower trays 515 and 516 are mutually independent and self-movable in a vertical direction. Each of the upper and lower tray drive motors M4 and M5 may be a stepping motor. The upper tray 515 and the lower tray 516 are attached to a rack 571 disposed in a vertical direction with respect to a frame 570 of the sheet stacking apparatus 500.

Each of the upper and lower dray drive motors M4 and M5 is attached to a base plate 572, and the drive thereof is transmitted to a pulley 574 using a timing belt 573 by a pulley 573*a* forcibly inserted on a motor shaft thereof.

The drive of each of the upper and lower tray drive motors M4 and M5 is also transmitted to a ratchet 576 by a shaft 575 connected to the pulley 574 with a parallel pin, the ratchet 576 being connected to the shaft 575 with a parallel pin. The ratchet 576 is urged to an idler gear 577 by a spring (not shown).

The idler gear 577 meshes with a gear 578 to transmit the drive of each of the motors M4 and M5, and the gear 578 meshes with a gear 579 fixed to one end of a shaft 580 to transmit the drive of each of the motors M4 and M5. The other end of the shaft 580 is provided with another gear 579 fixed thereto, and rotation of the gear 579 is transmitted to another gear 579 through the shaft 580. Accordingly, each of the upper and lower trays 515 and 516 is driven in both front and rear sides.

Moreover, these two gears 579 are coupled to the rack 571 through gears 581. Herein, each of the upper and lower trays 515 and 516 is horizontally held by placing two rollers 582 disposed on one side thereof into the rack 571 serving also as a roller receiver.

According to such a configuration, the drive of the upper and lower tray drive motors M4 and M5 is transmitted, so that the upper and lower trays 515 and 516 respectively are elevatable in a direction indicated by an arrow Z illustrated in FIG. 2.

The upper and lower trays 515 and 516 are integrated with the upper and lower tray drive motors M4 and M5 respectively, the respective idler gears 577, base plates 572 for supporting these members, sheet support plates (not shown) attached on the base plates 572, and other members to form respective tray units.

As illustrated in FIG. 2, upper and lower tray sheet surface detection sensors S4 and S5 are disposed to detect sheet surfaces (uppermost surface positions) on the upper and lower trays 515 and 516, respectively. Each of the upper and lower tray sheet surface detection sensors S4 and S5 is an optical sensor including a light emitting unit and a light receiving unit (not shown).

When a sheet surface is detected, each of the upper and lower trays 515 and 516 is moved up from a lower position. A home position is a position where stacked sheets on the upper and lower trays 515 and 516 or upper surfaces of the trays 515 and 516 block light of the upper and lower tray sheet surface detection sensors S4 and S5, respectively.

After moving to the respective home positions, the upper and lower trays 515 and 516 are once moved down.

Subsequently, sheets are discharged in sequence. When an upper surface of the stacked sheet blocks light of the upper or lower tray surface detection sensors S4 or S5, the corresponding upper or lower trays 515 or 516 is moved down until the optical axis appears.

Then, if sheets are removed from a tray such as the upper tray 515 and the lower tray 516, the tray is moved up to the home position in which light thereof is blocked. Such operation is repeated to grasp a position of the tray.

Figure 9:
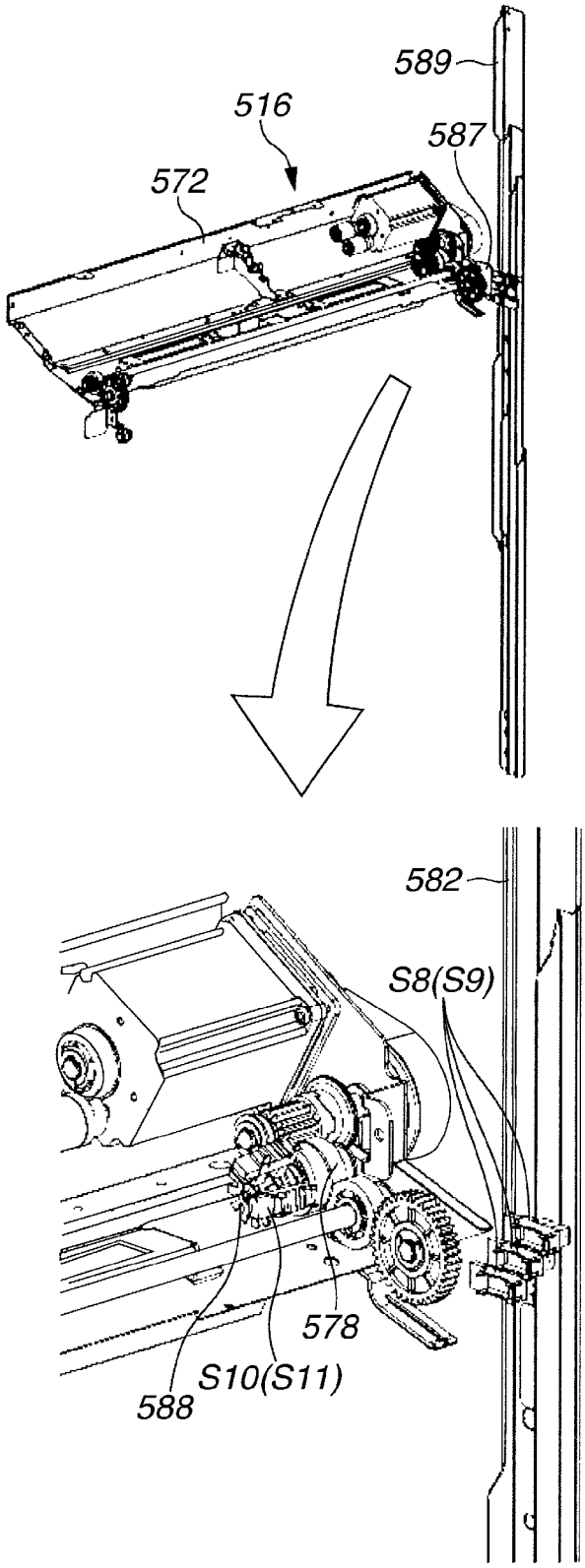
FIG. 9 is as a second diagram illustrating the elevating mechanism for each of the upper and lower trays.
Figure 14A:
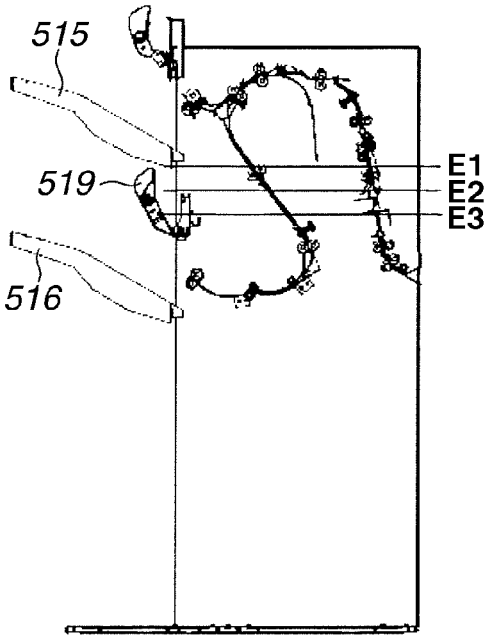
FIGS. 14A, 14B, and 14C are diagrams each illustrating a relationship between a position of the upper tray and a retracting position of the alignment member.
Figure 14B:
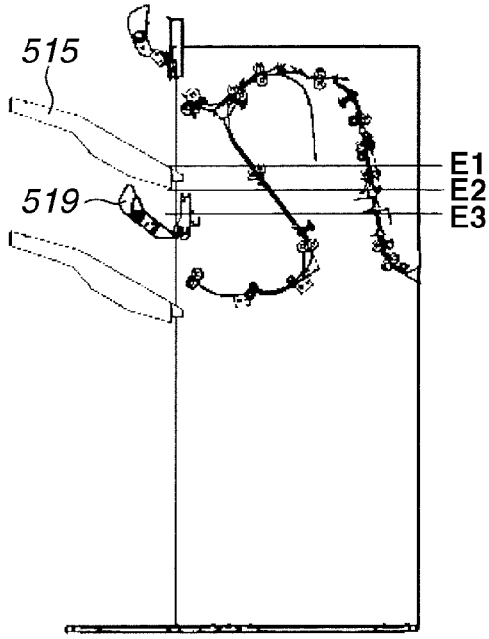
Figure 14C:
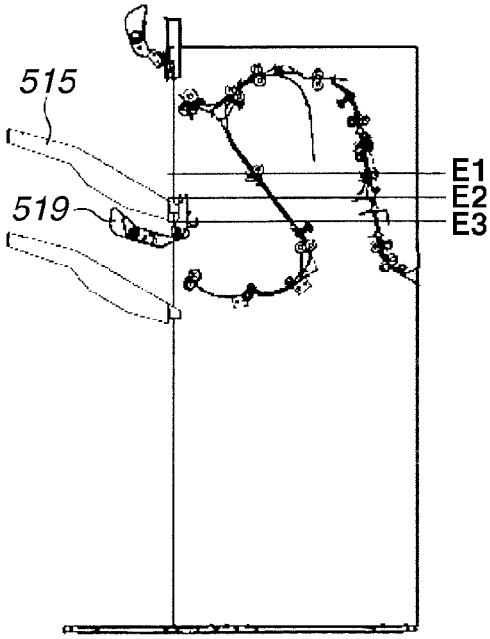

In FIG. 9, an upper tray area detection sensor S8 and a lower tray area detection sensor S9 detect areas in which the upper and lower trays 515 and 516, respectively, are positioned. For example, the upper tray area detection sensor S8 serving as a detection unit can detect an area in which the upper tray 515 is positioned as illustrated in FIGS. 14A, 14B, and 14C.

The upper (lower) tray area detection sensor S8 (S9) is fixed to a sensor attachment plate 587 attached to the base plate 572. When the upper and lower trays 515 and 516 are elevated, the upper and lower tray area detection sensor S8 and S9 respectively are elevated.

When the tray area detection sensor S8 (S9) is elevated, an area flag 589 attached to the frame 570 switches ON and OFF of the tray area detection sensor S8 (S9). Accordingly, the area position is determined.

In the present exemplary embodiment, a plurality of upper (lower) tray area detection sensors S8 (S9) is disposed, and the area flag 589 is shaped so that the number of sensors to be ON with elevation of the upper and lower trays 515 and 516 is determined. Thus, the areas positions of the upper and lower trays 515 and 516 are determined by the number of the sensors to be ON.

In FIG. 9, an upper tray motor clock detection sensor S10 and a lower tray motor detection sensor S11 detect clocks of the upper and lower tray drive motors M4 and M5, respectively. Positions of the upper and lower trays 515 and 516 are detected based on clock information from the upper and lower tray motor clock detection sensors S10 and S11, respectively.

The upper and lower tray motor clock detection sensors S10 and S11 count clocks of the upper and lower tray drive motors M4 and M5 respectively by detecting respective flag portions of rotation flags 588 attached on extension of the gears 578.

Figure 10:
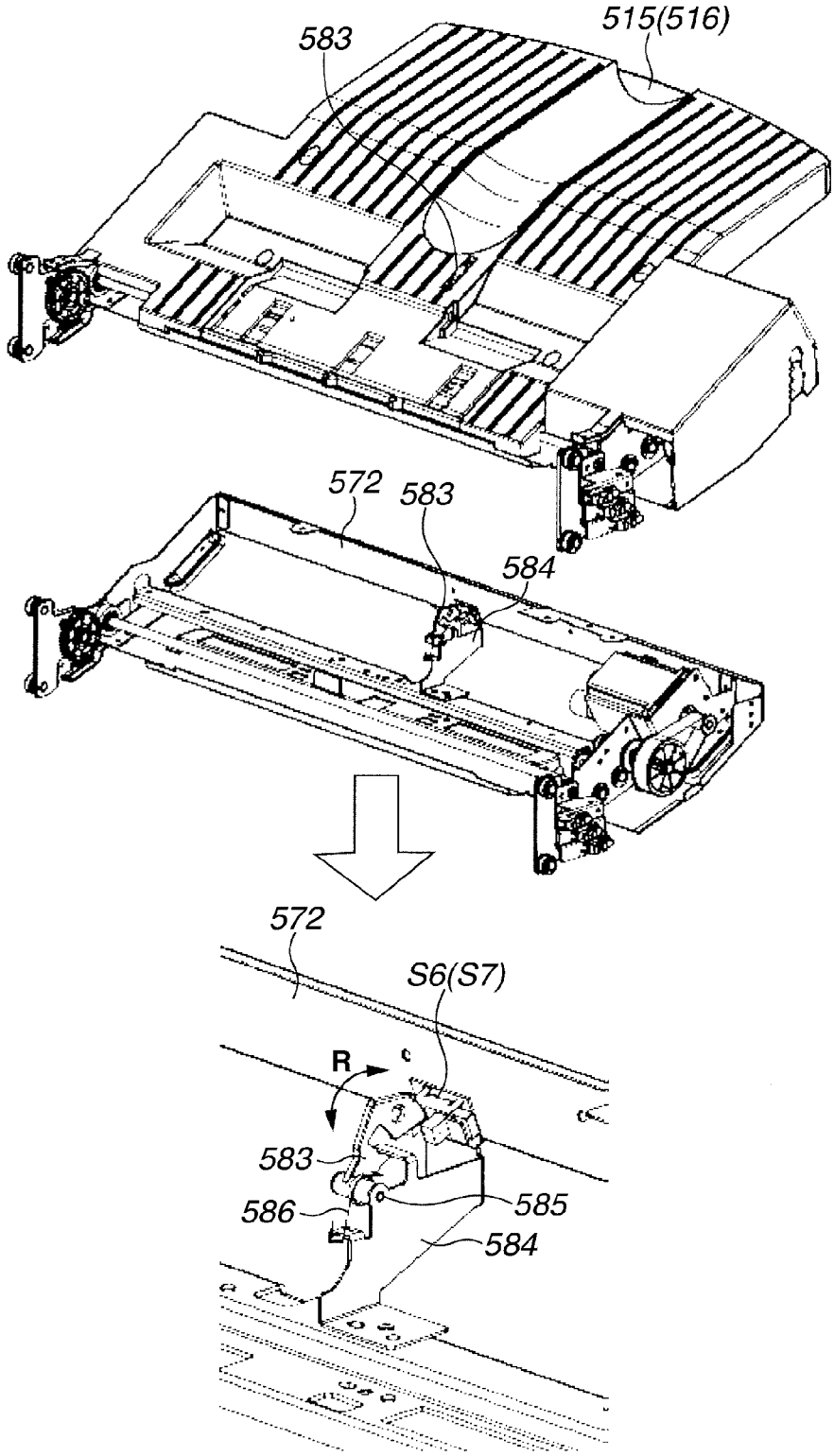
FIG. 10 is a diagram illustrating upper and lower tray sheet presence detection sensors disposed to upper and lower trays, respectively.

Moreover, as illustrated in FIG. 10, each of the upper and lower trays 515 and 516 has a sheet presence detection flag 583 protruded therefrom. The sheet presence detection flag 583 detects the presence or absence of a stacked sheet, and is attached to the base plate 572 through a sheet presence detection plate 584.

The sheet presence detection flag 583 rotates around a flag rotation shaft 585 in a direction indicated by an arrow R illustrated in FIG. 10. The flag rotation shaft 585 is swaged with the sheet presence detection plate 584.

When a sheet is not stacked on a tray such as the upper tray 515 and the lower tray 516, the sheet presence detection flag 583 is pulled by a rotation spring 586 and is protruded from the tray. Herein, an upper tray sheet presence detection sensor S6 or a lower tray sheet presence detection sensor S7 corresponding to the tray is OFF. The upper and lower tray sheet presence detection sensors S6 and S7 serving as sheet presence detection unit detect the presence or absence of sheets stacked on the respective trays attached to the sheet presence detection plates 584.

On the other hand, when sheets are stacked on a tray such as the upper tray 515 and the lower tray 516, the sheet presence detection flag 583 rotates downward by weight of the stacked sheets. The upper and lower tray sheet presence detection sensor S6 or S7 becomes ON with a downward movement of the corresponding sheet presence detection flag 583. That is, when sheets are stacked on the tray, the corresponding tray sheet presence detection sensor becomes ON from OFF.

Figure 11:
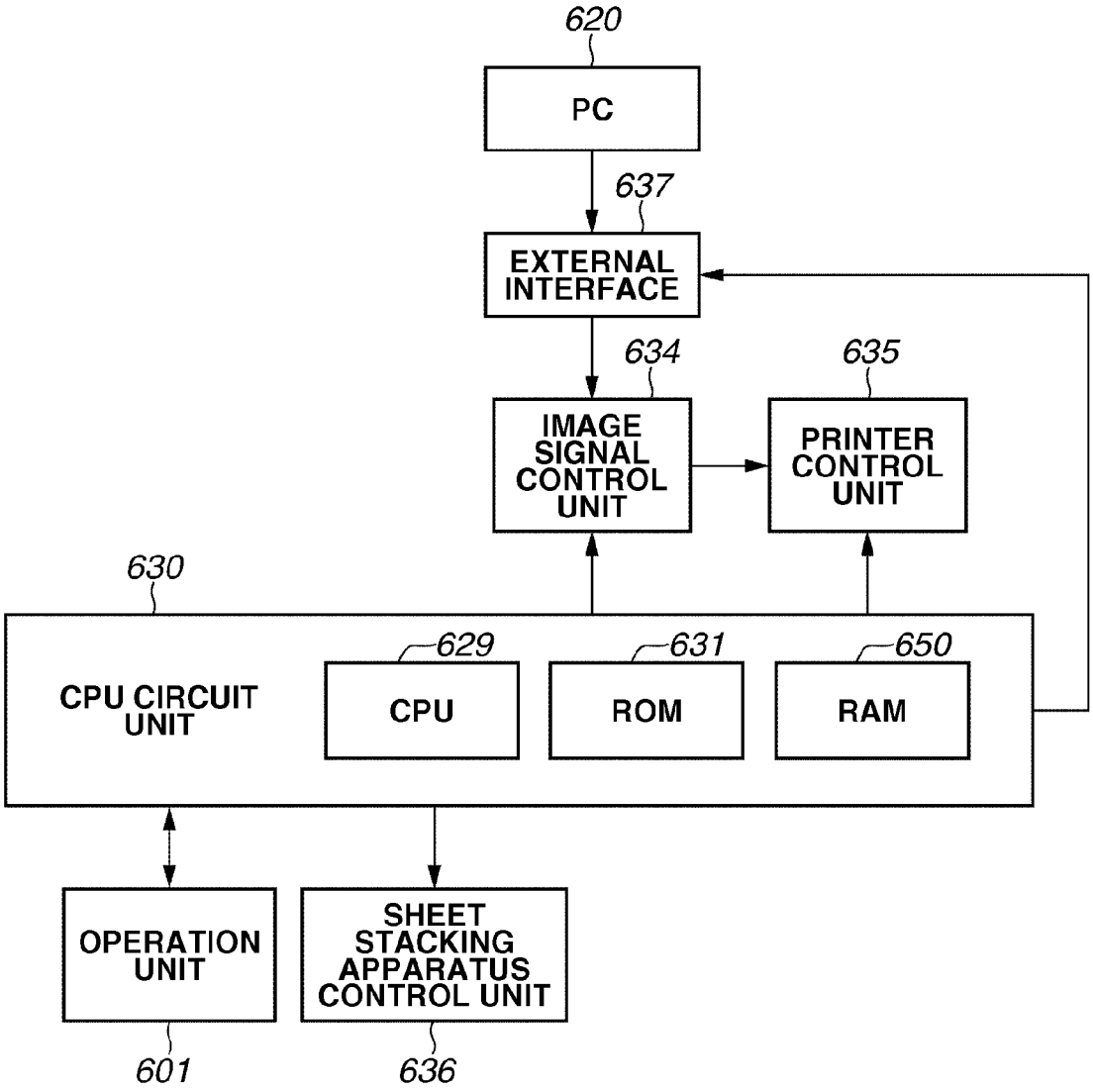
FIG. 11 is a control block diagram of the monochrome/color copying machine.

FIG. 11 is a control block diagram of the monochrome/color copying machine 100. The CPU circuit unit 630 includes a CPU 629, a read only memory (ROM) 631, and a random access memory (RAM) 650.

The CPU circuit unit 630 controls an image signal control unit 634, a printer control unit 635, a sheet stacking apparatus control unit 636, and an external interface 637. The CPU circuit unit 630 controls these units according to the programs stored in the ROM 631 and the settings of the operation unit 601. The RAM 650, for example, is used as an area for temporally holding control data and a work area for calculation relating to the control.

The printer control unit 635 controls the copying machine body 100A, and the sheet stacking apparatus control unit 636 controls the sheet stacking apparatus 500. The external interface 637 serves as an interface from a computer (personal computer (PC)) 620. The external interface 637 rasterizes print data into an image, and outputs such an image to the image signal control unit 634. The image signal control unit 634 outputs image information to the printer control unit 635. The printer control unit 635 inputs the image information to an exposure control unit (not illustrated).

Figure 12:
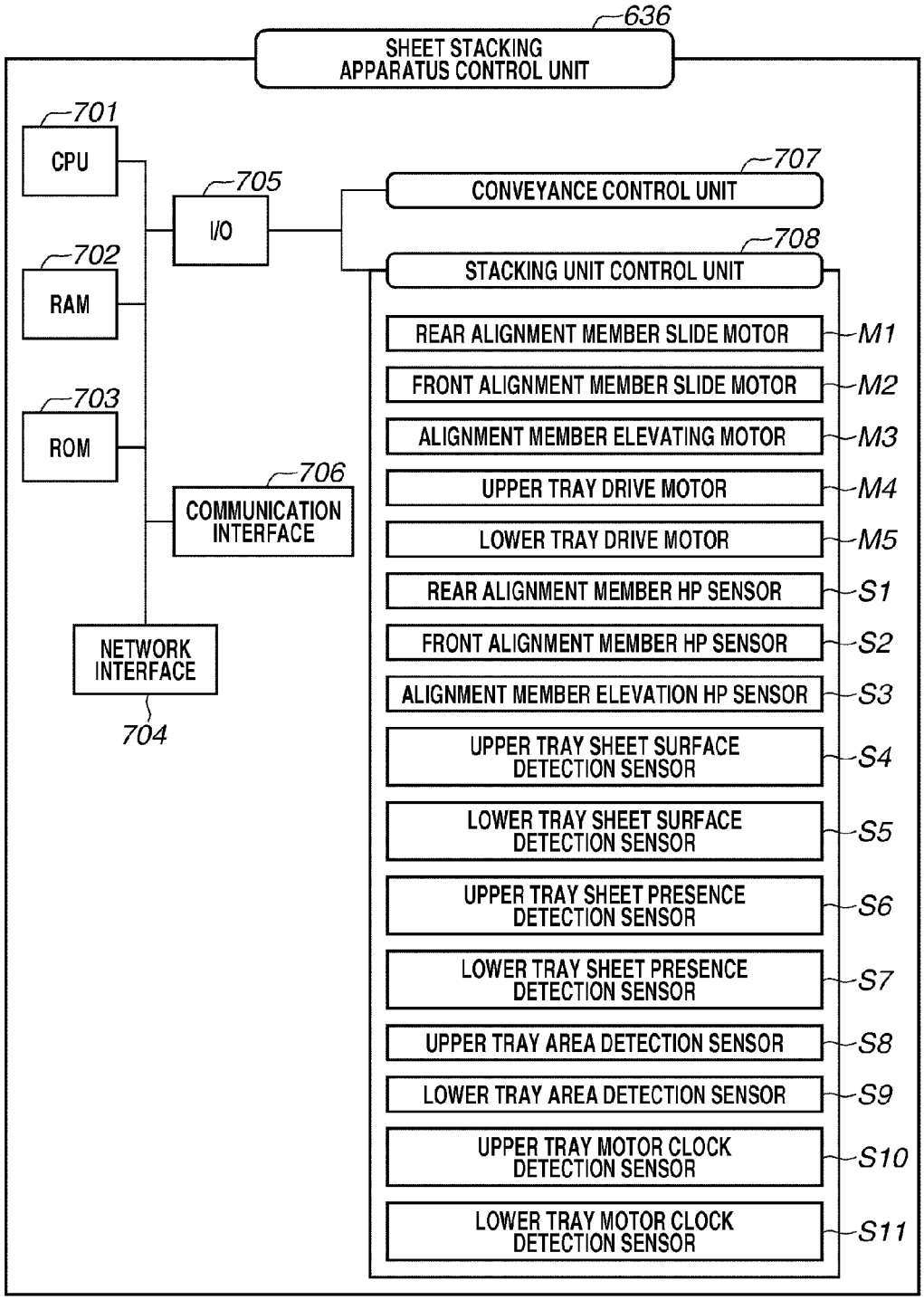
FIG. 12 is a control block diagram of a sheet stacking apparatus control unit for controlling the sheet stacking apparatus.

FIG. 12 is a control block diagram of the sheet stacking apparatus control unit 636. The present exemplary embodiment describes a case where the sheet stacking apparatus control unit 636 is mounted on the sheet stacking apparatus 500. However, the present exemplary embodiment is not limited to such a case. For example, the sheet stacking apparatus control unit 636 may be provided in the copying machine body 100A by being integrated with the CPU circuit unit 630 to control the sheet stacking apparatus 500 from the copying machine body 100A.

The sheet stacking apparatus control unit 636 includes a CPU 701, a RAM 702, a ROM 703, an input and output (I/O) unit 705, a network interface 704, and a communication interface 706. The I/O unit 705 inputs and outputs signals with respect to a conveyance control unit 707 and a stacking unit control unit 708.

The stacking unit control unit 708 is connected to the rear and front alignment member slide motors M1 and M2, the alignment member elevating motor M3, and the upper and lower tray drive motors M4 and M5.

Moreover, to the stacking unit control unit 708, the rear and front alignment member HP sensors S1 and S2, the alignment member elevation HP sensor S3, the upper and lower tray sheet surface detection sensors S4 and S5, and the upper and lower tray sheet presence detection sensors S6 and S7 are connected.

Further, to the stacking unit control unit 708, the upper and lower tray area detection sensors S8 and S9, and the upper and lower tray motor clock detection sensors S10 and S11 are connected. The stacking unit control unit 708 controls these motors M1 through M5 based on signals from the sensors S1 through S11.

In the present exemplary embodiment, the stacking unit control unit 708 detects an area in which the upper tray 515 is positioned within areas from upper and lower limit positions of the upper tray 515 to the upper tray sheet surface detection sensor S4.

A retracting position of the alignment member 519 is controlled based on the detection result. In the present exemplary embodiment, the number of clocks at the time of driving the alignment member elevating motor M3 is controlled to control the retracting position of the alignment member 519.

Figure 13:
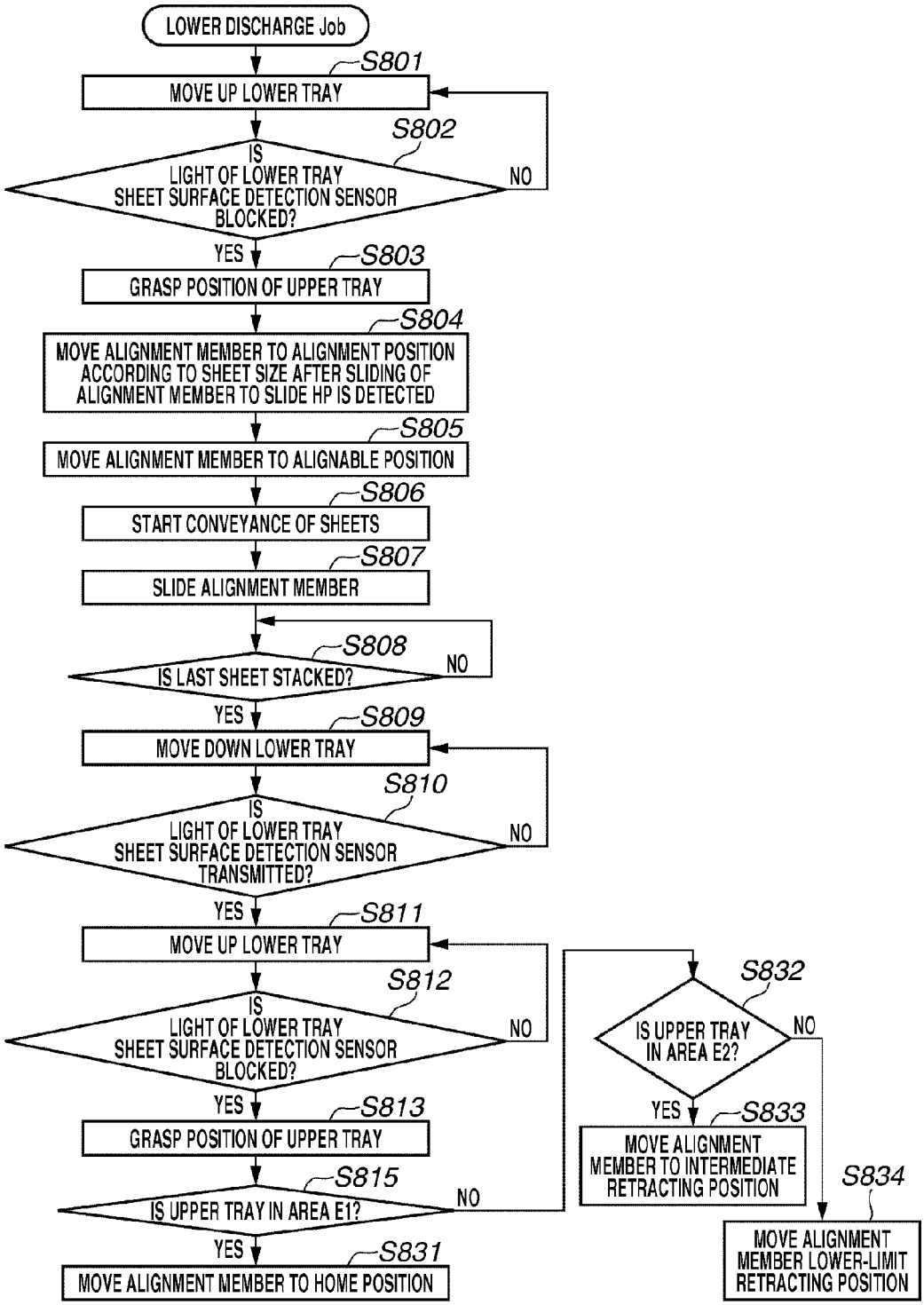
FIG. 13 is a flowchart illustrating control of a retracting position of an alignment member provided in the tray alignment unit.

FIG. 13 is a flowchart illustrating control of the retracting position of the alignment member 519 according to the present exemplary embodiment.

In step S801, when a user selects a mode for stacking sheets on lower tray 516, the sheet stacking apparatus control unit 636 drives lower tray drive motor M5, and causes the lower tray 516 to move up. If the moved-up lower tray 516 or a stacked sheet blocks light of the lower tray sheet surface detection sensor S5 (YES in step S802), then in step S803, the sheet stacking apparatus control unit 636 grasps (determines) an area in which the upper tray 515 is positioned at this time.

In the present exemplary embodiment, a position of the upper tray 515 is determined based on a signal from the upper tray area detection sensor S8 and a signal from the upper tray motor clock detection sensor S10.

Then, the sheet stacking apparatus control unit 636 drives the rear and front alignment member slide motors M1 and M2, and causes the alignment member 519 to perform initial operation and to move to a slide HP. Herein, such a slide movement of the alignment member 519 to the slide HP is detected by the rear and front alignment member HP sensors 51 and S2 disposed in a rear side and a front side, respectively.

In step S804, the sheet stacking apparatus control unit 636 drives the rear and front alignment member slide motors M1 and M2, and causes the alignment member 519 to move to an alignment position in a width direction according to a sheet size after the rear and front alignment member HP sensors 51 and S2 detect the slide movement of the alignment member 519 to the slide HP. The alignment position of the alignment member 519 is located at a position of a predetermined distance from both ends in a width direction of a sheet.

Subsequently, the sheet stacking apparatus control unit 636 drives the alignment member elevating motor M3, and causes the alignment member 519 to rotate and move up to an elevation HP. In step S805, when the alignment member elevation HP sensor S3 detects that the alignment member 519 reaches the elevation HP, the sheet stacking apparatus control unit 636 drives the alignment member elevating motor M3, and causes the alignment member 519 to move down to an alignable position.

The alignable position is a position in which the alignment member 519 contacts a sheet by moving in a width direction after being moved down. Thus, after moving to the alignable position, the alignment member 519 moves in the width direction to contact the sheet, thereby aligning a sheet width direction.

There are cases where the movement of the alignment member 519 to the elevation HP causes interference between the alignment member 519 and the upper tray 515 depending on a position of the upper tray 515. In such cases, in step S805, the alignment member 519 is moved to the alignable position without being moved to the elevation HP.

In step S806, the sheet stacking apparatus control unit 636 causes conveyance of sheets to start after the alignment member 519 is moved to the alignable position. In step S807, when a tailing end of a sheet passes through the lower discharge roller 514 and is stacked on the lower tray 516, the sheet stacking apparatus control unit 636 causes the alignment member 519 in the alignable position according to the sheet size to slide in a width direction. Thus, the width direction of the sheets stacked on the lower tray 516 are aligned.

Such operation is repeated until a last sheet is stacked on the lower tray 516.

If the last sheet is stacked (YES in step S808) and is aligned, the processing proceeds to step S809. In step S809, the sheet stacking apparatus control unit 636 drives the lower tray drive motor M5, and causes the lower tray 516 to move down so that a sheet surface position is checked when light of the lower tray sheet surface detection sensor S5 is blocked.

If the light of the lower tray sheet surface detection sensor S5 is transmitted (YES in step S810), then in step S811, the sheet stacking apparatus control unit 636 causes the lower tray 516 to move up. If the moved-up lower tray 516 or a stacked sheet blocks the light of the lower tray sheet surface detection sensor S5 (YES in step S812), then in step S813, the sheet stacking apparatus control unit 636 re-grasps (re-determines) an area in which the upper tray 515 is positioned at this time.

Such a process is performed because there are cases where a position of the lower tray 516 shifts when the lower tray 516 is to be moved upward. For example, when the upper tray sheet presence detection sensor S6 detects the absence of a sheet on the upper tray 515, the upper tray 515 can be determined as being in an upper limit position. In such a case, the alignment member 519 is retracted (moved up) to a home position.

The sheet stacking apparatus control unit 636 controls a retracting position of the alignment member 519 at the time of resuming sheet stacking or removing sheets based on the determination result of the area position of the upper tray 515.

For example, if the upper tray 515 is in an upper limit position located above an area E1 as illustrated in FIG. 14A (YES in step S815), then in step S831, the sheet stacking apparatus control unit 636 retracts (moves up) the alignment member 519 to a home position as a retracting position illustrated in FIG. 14A.

If the upper tray 515 is not positioned above the area E1 (NO in step S815), and the upper tray 515 is positioned between the area E1 and area E2 illustrated in FIG. 14B (YES in step S832), then in step S833, the sheet stacking apparatus control unit 636 causes the alignment member 519 to be retracted to an intermediate retracting position illustrated in FIG. 14B.

If the upper tray 515 is not positioned above the area E1 as illustrated in FIG. 14C (NO in step S815), and the upper tray 515 is positioned between the area E2 and an area E3 (lower limit position) (NO in step S832), then in step S834, the sheet stacking apparatus control unit 636 causes the alignment member 519 to be retracted to a lower limit retracting position illustrated in FIG. 14B.

Therefore, a change in a retracting position of the alignment member 519 according to a position of the upper tray 515 can reduce occurrences of interference between the upper tray 515 and the alignment member 519 regardless of a position of the upper tray 515. Even when sheets are removed from the lower tray 516, the alignment member 519 can be moved up to a position corresponding to a position of the upper tray 515, thereby enhancing the sheet removability.

On the other hand, when sheets are stacked on the upper tray 515, the upper tray 515 moves down as an amount of the stacked sheets increases. Whenever a sheet is discharged on the upper tray 515, the upper tray alignment unit 517 regulates a position in a width direction of the sheet.

Figure 15A:
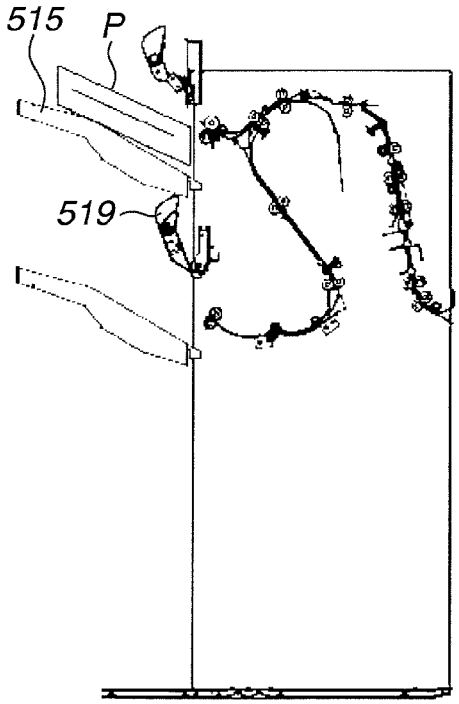
FIGS. 15A, 15B, and 15C are diagrams each illustrating a state in which the alignment member moves down as the upper tray moves down.

The alignment member 519 of the lower tray alignment unit 518 is being retracted in a home position illustrated in FIG. 2, for example. Then, sheets P are stacked in sequence. Such a stack of the sheets P causes the upper tray 515 to move down to a position at which the alignment member 519 is pushed as illustrated in FIG. 15A, and thus the upper tray 515 contacts the alignment member 519 from above.

The alignment member 519 is supported by the first alignment spindle 520 and the third spindle 532 to be rotatable around the first alignment spindle 520 so that the alignment member 519 moves down.

Figure 15B:
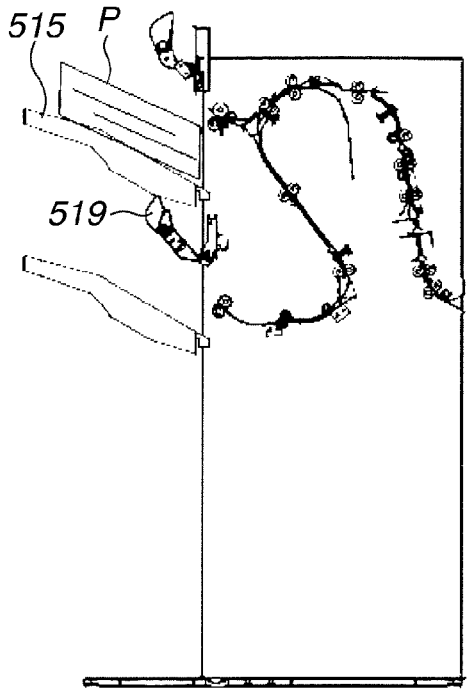
Figure 15C:
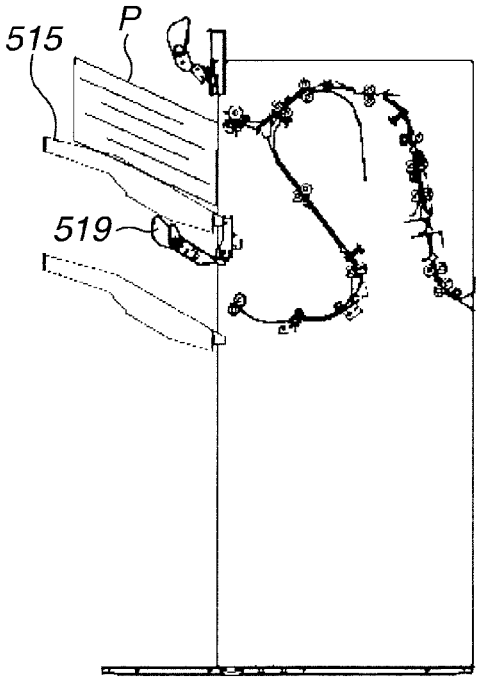

Accordingly, when the upper tray 515 further moves down, the alignment member 519 moves down while being pushed by the upper tray 515 as illustrated in FIGS. 15B and 15C. That is, when sheets P are stacked on the upper tray 515, a downward movement of the upper tray 515 moves the alignment member 519 downward without driving the alignment member elevating motor M3.

Therefore, the lower tray alignment unit 518 for sequentially aligning a position in a width direction of sheets stacked on the lower tray 516 is provided between the elevatable upper and lower trays 515 and 516, thereby stably staking a large number of the sheets.

That is, the lower tray alignment unit 518 is disposed between a plurality of sheet stacking units, and sequentially aligns a position in a width direction of the sheets stacked on a lower sheet stacking unit among the plurality of sheet stacking units, thereby stably staking a large number of sheets. In the present exemplary embodiment, even if a large number of curled sheets are stacked on a lower stacking tray, deterioration of the stackability by inclination of the stacked sheets can be reduced.

Moreover, a retracting position of the alignment member 519 is changed according to a position of the upper tray 515, so that the alignment member 519 can be prevented from being in contact with the upper tray 515 when moving up.

In addition, even when sheets on the lower tray 516 are removed, the alignment member 519 can be moved up to a position corresponding to a position of the upper tray 515, thereby enhancing the sheet removability.

In the present exemplary embodiment, a position of the upper tray 515 is determined based on a signal from the upper tray area detection sensor S8 and a signal from the upper tray motor clock detection sensor S10.

However, for example, when the upper tray sheet presence detection sensor S6 detects the absence of a sheet on the lower tray 516, the upper tray 515 can be determined to be at an upper limit position. In such a case, the alignment member 519 is retracted to a home position with a maximum upward retraction amount (movement amount) thereof. Accordingly, the retracting position of the alignment member 519 can be controlled based on the detection result of the upper tray sheet presence detection sensor S6.

The description has been made on the case where the alignment member 519 is moved up to a retracting position corresponding to a position of the upper tray 515 when sheets discharged and stacked on the lower tray 516 are removed, so that the sheet removability is enhanced. However, the present invention is not limited thereto.

For example, when sheets discharged on the lower tray 516 are removed, the lower tray 516 may be moved down to enlarge a space between the alignment member 519 having moved to a retracting position corresponding to a position of the upper tray 515 and thereof, thereby enhancing the sheet removability.

Figure 16:
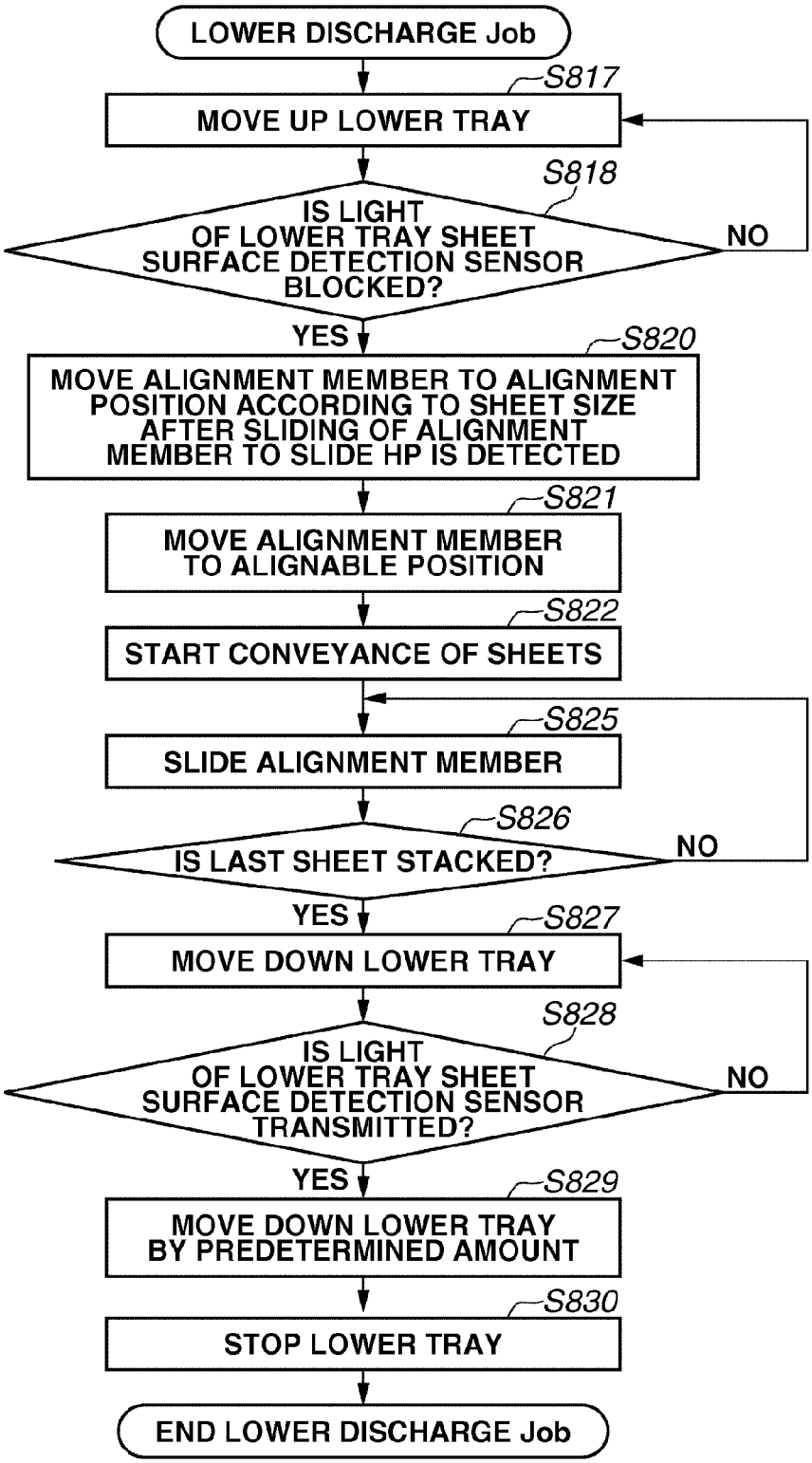
FIG. 16 is a flowchart illustrating control of a retracting position of an alignment member provided in a tray alignment unit and control of a position of a lower tray of a sheet stacking apparatus according to a second exemplary embodiment.

A second exemplary embodiment of the present invention is now described. In the second exemplary embodiment, a lower tray 516 is moved down at the time of removing a discharged sheet. FIG. 16 is a flowchart illustrating control of a retracting position of an alignment member 519 and control of a position of the lower tray 516 according to the present exemplary embodiment.

In step S817, when a user selects a mode for staking a sheet on the lower tray 516, a sheet stacking apparatus control unit 636 drives a lower tray drive motor M5, and causes the lower tray 516 to move up. If the moved-up lower tray 516 or a stacked sheet blocks light of a lower tray sheet surface detection sensor S5 (YES in step S818), the sheet stacking apparatus control unit 636 grasps (determines) an area in which an upper tray 515 is positioned at this time.

Then, the sheet stacking apparatus control unit 636 drives rear and front alignment member slide motors M1 and M2, and causes the alignment member 519 to perform initial operation and to move to a slide HP. Herein, such a slide movement of the alignment member 519 to the slide HP is detected by rear and front alignment member HP sensors S1 and S2 disposed in a rear side and a front side, respectively.

In step S820, the sheet stacking apparatus control unit 636 drives the rear and front alignment member slide motors M1 and M2, and causes the alignment member 519 to move to an alignment position according to a sheet size after the rear and front alignment member HP sensors S1 and S2 detect the slide of the alignment member 519 to the slide HP.

Subsequently, the sheet stacking apparatus control unit 636 drives an alignment member elevating motor M3, and causes the alignment member 519 to rotate and move up to an elevation HP. In step S821, when the alignment member elevation HP sensor S3 detects that the alignment member 519 reaches the elevation HP, the sheet stacking apparatus control unit 636 drives the alignment member elevating motor M3, and causes the alignment member 519 to move down to an alignable position.

There are cases where the movement of the alignment member 519 to the elevation HP causes interference between the alignment member 519 and the upper tray 515 depending on a position of the upper tray 515. In such cases, in step S821, the alignment member 519 is moved to the alignable position without being moved to the elevation HP.

In step S822, the sheet stacking apparatus control unit 636 causes conveyance of sheets to start after the alignment member 519 is moved to the alignable position. In step S825, when a tailing end of a sheet passes through a lower discharge roller 514 and is stacked on the lower tray 516, the sheet stacking apparatus control unit 636 causes the alignment member 519 in the alignable position according to the sheet size to slide in a width direction. Thus, the width direction of the sheets stacked on the lower tray 516 are aligned.

Such operation is repeated until a last sheet is stacked on the lower tray 516.

If the last sheet is stacked (YES in step S826) and is aligned, the processing proceeds to step S827. In step S827, the sheet stacking apparatus control unit 636 drives the lower tray drive motor M5, and causes the lower tray 516 to move down when light of the lower tray sheet surface detection sensor S5 is blocked. If the light of the lower tray sheet surface detection sensor S5 is transmitted (YES in step S828), then in step S829, the sheet stacking apparatus control unit 636 causes the lower tray 516 to move down by a predetermined amount. In step S830, the sheet stacking apparatus control unit 636 stops the movement of the lower tray 516.

Figure 17A:
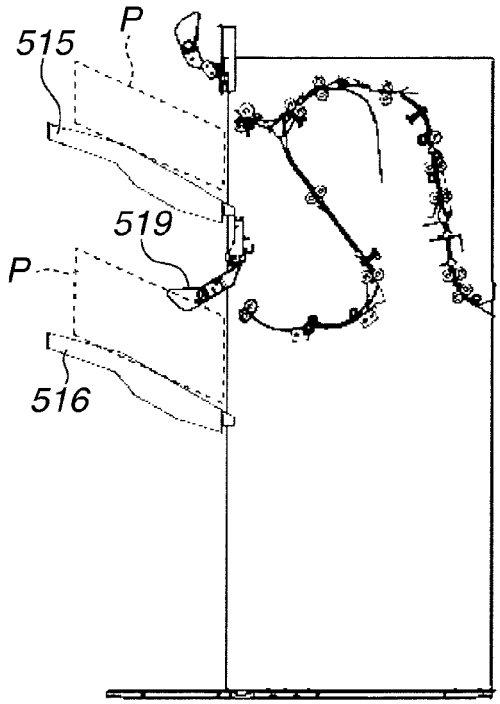
FIGS. 17A and 17B are diagrams each illustrating a positional relation among an alignment member, a lower tray, and an upper tray at the time of removing stacked sheets from the lower tray.
Figure 17B:
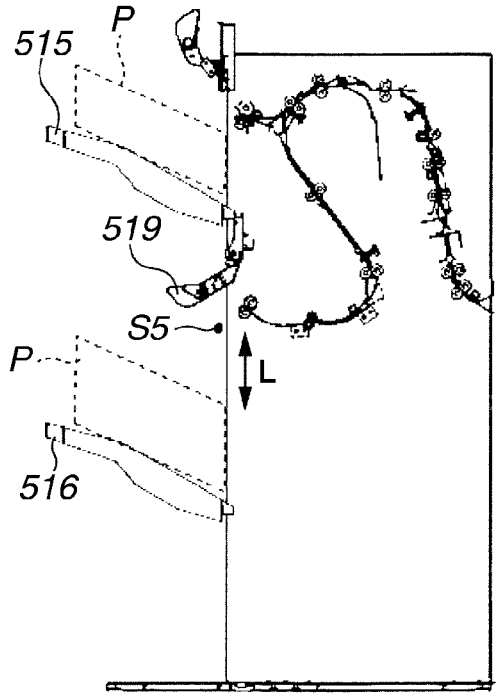

FIGS. 17A and 17B are diagrams illustrating a position of the lower tray 516 in such a downward movement. FIG. 17A illustrates a state in which sheets P are being stacked on the lower tray 516 while being aligned. When such a job is completed, the lower tray 516 is moved down by a predetermined amount L from a state in which the light of the lower tray sheet surface detection sensor S5 is transmitted as illustrated in FIG. 17B.

The lower tray 516 is moved down by the predetermined amount L subsequent to the job completion, so that the alignment member 519 and the sheets P on the lower tray 516 have a positional relation in which interference does not occur between them. Accordingly, the removability of the sheets P on the lower tray 516 can be enhanced.

Figure 18A:
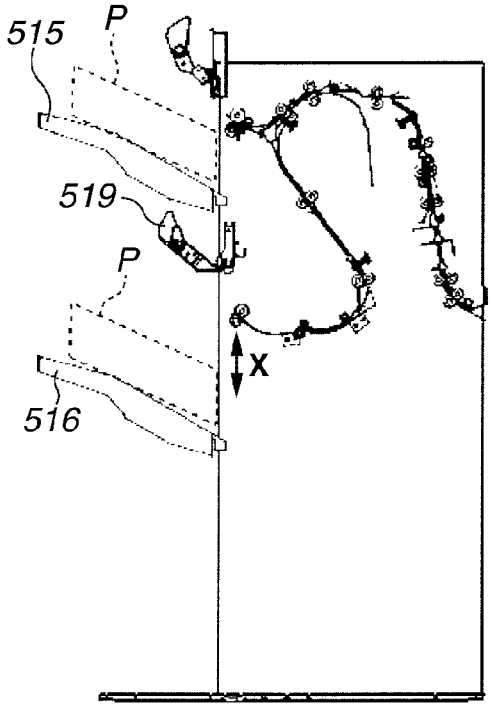
FIGS. 18A and 18B are diagrams each illustrating a positional relation among the alignment member, the lower tray, and the upper tray at the time of removing stacked sheets from the upper tray.
Figure 18B:
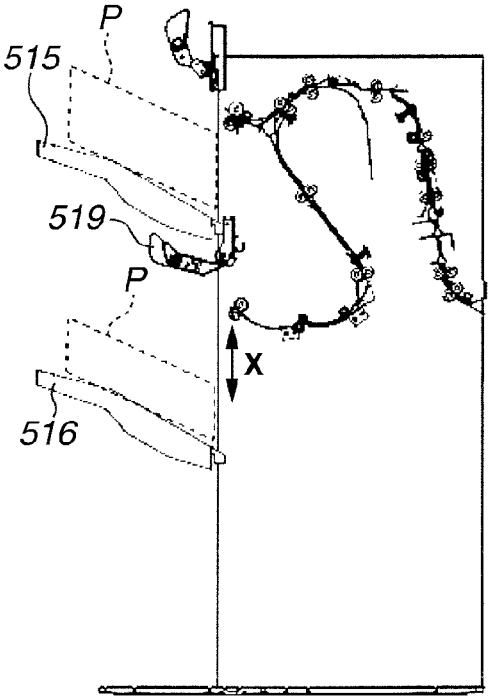

The predetermined amount L is used in the present exemplary embodiment. However, a downward amount X as illustrated in FIGS. 18A and 18B may be used when the lower tray 516 is moved down subsequent to the job completion. The downward amount X may be changed according to a retracting position of the alignment member 519 corresponding to a position of the upper tray 515.

For example, when a retracting position of the alignment member 519 is lower than an elevation HP, the downward amount X of the lower tray 516 may be increased by an amount of such a difference. The downward amount X of the lower tray 516 can be changed according to a retracting position of the alignment member 519, thereby ensuring certain sheet removability regardless of the retracting position of the alignment member 519.

The exemplary embodiments have been described with respect to the example in which the sheet stacking apparatus 500 includes two (a plurality of) trays 515 and 516. However, the exemplary embodiment may be applied to a sheet stacking apparatus including three or more trays (sheet stacking units).

While the present disclosure has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-167588 filed Jul. 29, 2011, which is hereby incorporated by reference herein in its entirety.

What is claimed is:

1. A sheet stacking apparatus comprising:

a first discharge unit configured to discharge a sheet;

a first stacking unit on which the sheet discharged by the first discharge unit is stacked;

a second discharge unit disposed below the first discharge unit and configured to discharge a sheet;

a second stacking unit on which the sheet discharged by the second discharge unit is stacked;

a first elevating unit configured to elevate the first stacking unit;

an alignment unit configured to align a position of the sheet being stacked on the second stacking unit in a width direction perpendicular to a sheet discharging direction;

a moving unit configured to move the alignment unit to one of an alignment position where a sheet is to be aligned, a retracting position retracted above the alignment position and an intermediate retracting position between the alignment position and the retracting position;

a determining unit configured to determine a position of the first stacking unit in a vertical direction; and a control unit configured to control the moving unit based on a determination of the determining unit.

2. The sheet stacking apparatus according to claim 1, further comprising:

wherein the alignment unit includes:

an alignment member configured to move in the width direction and align the position of the sheet stacked on the second sheet stacking unit in the width direction;

wherein, after a print job is ended, the control unit moves the alignment member from the alignment position to the retracting position or the intermediate retracting position.

3. The sheet stacking apparatus according to claim 2, wherein, after the first sheet stacking unit is moved down and contacts the alignment member having moved to the retracting position, the control unit controls the first sheet stacking unit and the moving unit so that the first sheet stacking unit moves down with the alignment member.

4. The sheet stacking apparatus according to claim 1, further comprising:

a detection unit configured to detect a position of the first sheet stacking unit wherein, the determining unit determines the position of the first stacking unit based on a detection result of the detection unit.

5. The sheet stacking apparatus according to claim 1, further comprising:

a sheet presence detection unit configured to detect presence or absence of a stacked sheet on the first sheet stacking unit, wherein, the determining unit determines the position of the first stacking unit based on a detection result of the sheet presence detection unit.

6. The sheet stacking apparatus according to claim 1, wherein, after a print job is ended, the control unit moves the second sheet stacking unit so that the second sheet stacking unit is moved down.

7. The sheet stacking apparatus according to claim 6, wherein, when the second sheet stacking unit is moved down, the control unit controls the second sheet stacking unit so that the second sheet stacking unit is moved down to a position according to a position of the alignment unit.

8. The sheet stacking apparatus according to claim 1, wherein the control unit is configured to control the moving unit to move the alignment unit to the intermediate retracting position in a case where the determining unit determines that the first stacking unit is positioned below a predetermined position, and wherein the control unit is configured to control the moving unit to move the alignment unit to the retracting position in a case where the determining unit determines that the first staking unit is positioned above the predetermined position.

9. The sheet stacking apparatus according to claim 1, wherein the alignment unit is not in contact with the first stacking unit at the intermediate retracting position.

10. The sheet stacking apparatus according to claim 1, further comprising:

another alignment unit configured to align a position of the sheet being stacked on the first stacking unit in a width direction perpendicular to a sheet discharging direction.

11. The sheet stacking apparatus according to claim 1, wherein the moving unit is configured to rotate the alignment unit.

12. The sheet stacking apparatus according to claim 1, wherein, the moving unit is configured to move the alignment unit to one of the alignment position where a sheet is to be aligned, the retracting position retracted above the alignment position, the intermediate retracting position between the alignment position and the retracting position, and a lower retracting position between the alignment position and the intermediate retracting position.

13. The sheet stacking apparatus according to claim 1, wherein the control unit is configured to control the moving unit so that the alignment unit does not contact the first sheet stacking unit.

14. An image forming apparatus comprising:

an image forming unit configured to form an image on a sheet;

a first discharge unit disposed configured to discharge sheets with the images formed thereon;

a first stacking unit on which the sheet discharged by the first discharge unit is stacked;

a second discharge unit disposed below the first discharge unit and configured to discharge a sheet;

a second stacking unit on which the sheet discharged by the second discharge unit is stacked;

a first elevating unit configured to elevate the first stacking unit;

an alignment unit configured to align a position of the sheet being stacked on the second stacking unit in a width direction perpendicular to a sheet discharging direction;

a moving unit configured to move the alignment unit to one of an alignment position where a sheet is to be aligned, a retracting position retracted above the alignment position and an intermediate retracting position between the alignment position and the retracting position;

a determining unit configured to determine a position of the first stacking unit in a vertical direction; and a control unit configured to control the moving unit based on a determination of the determining unit.

15. The image forming apparatus according to claim 14, further comprising:

wherein the alignment unit includes:

an alignment member configured to move in the width direction and align the position of the sheet stacked on the second sheet stacking unit in the width direction;

wherein, after a print job is ended, the control unit moves the alignment member from the alignment position to the retracting position or the intermediate retracting position.

16. The image forming apparatus according to claim 15, wherein, after the first sheet stacking unit is moved down and contacts the alignment member having been moved to the retracting position, the control unit controls the first sheet stacking unit and the moving unit so that the first sheet stacking unit moves down with the alignment member.

17. The image forming apparatus according to claim 14, further comprising:

a detection unit configured to detect a position of the first sheet stacking unit wherein, the determining unit determines the position of the first stacking unit based on a detection result of the detection unit.

18. The image forming apparatus according to claim 14, further comprising:

a sheet presence detection unit configured to detect presence or absence of a stacked sheet on the first sheet stacking unit, wherein, the determining unit determines the position of the first stacking unit based on a detection result of the sheet presence detection unit.

19. The image forming apparatus according to claim 14, wherein, after a print job is ended, the control unit moves the second sheet stacking unit so that the second sheet stacking unit is moved down.

20. The image forming apparatus according to claim 19, wherein, when the second sheet stacking unit is moved down, the control unit controls the second sheet stacking unit so that the second sheet stacking unit is moved down to a position according to a position of the alignment unit.

* * * * *